US008413679B2

(12) United States Patent
Wenske et al.

(10) Patent No.: US 8,413,679 B2
(45) Date of Patent: Apr. 9, 2013

(54) MODULAR CONTROL DEVICE, ESPECIALLY OF AN ELECTRO-FLUIDIC TYPE

(75) Inventors: Eduard Wenske, Ludwigsburg (DE); Heiko Kuhbauch, Kongen (DE)

(73) Assignee: Festo AG & Co. KG, Esslingen (DE)

( * ) Notice: Subject to any disclaimer, the term of this patent is extended or adjusted under 35 U.S.C. 154(b) by 0 days.

(21) Appl. No.: 12/672,035

(22) PCT Filed: Apr. 15, 2008

(86) PCT No.: PCT/EP2008/002981

§ 371 (c)(1), (2), (4) Date: Feb. 3, 2010

(87) PCT Pub. No.: WO2009/127223

PCT Pub. Date: Oct. 22, 2009

(65) Prior Publication Data

US 2011/0192481 A1 Aug. 11, 2011

(51) Int. Cl.
*F15B 13/00* (2006.01)

(52) U.S. Cl.
USPC ..... 137/560; 137/884; 137/269; 137/271; 137/382; 137/625.64

(58) Field of Classification Search ..... 137/560, 137/625.64, 269, 271, 884, 377, 382
See application file for complete search history.

(56) References Cited

U.S. PATENT DOCUMENTS

| | | | | |
|---|---|---|---|---|
| 3,504,704 | A * | 4/1970 | Beckett et al. | 137/625.64 |
| 4,550,964 | A * | 11/1985 | Donais et al. | 439/142 |
| 5,333,647 | A * | 8/1994 | Fukano et al. | 137/884 |
| 5,419,715 | A | 5/1995 | Laveissiere | |
| 5,983,921 | A * | 11/1999 | Miyazoe et al. | 137/269 |
| 6,109,298 | A * | 8/2000 | Kaneko et al. | 137/551 |
| 6,155,287 | A * | 12/2000 | Matarai et al. | 137/382 |
| 6,164,323 | A * | 12/2000 | Smith et al. | 137/554 |
| 6,189,571 | B1 * | 2/2001 | Hedlund | 137/884 |
| 6,213,153 | B1 * | 4/2001 | Hayashi et al. | 137/884 |
| 6,302,149 | B1 * | 10/2001 | Sato et al. | 137/884 |
| 6,520,202 | B2 * | 2/2003 | Miyazoe et al. | 137/554 |
| 6,536,447 | B1 * | 3/2003 | Fioravanti et al. | 132/299 |
| 6,874,537 | B2 * | 4/2005 | Hayashi et al. | 137/884 |
| 6,874,756 | B2 * | 4/2005 | Hawkins et al. | 251/291 |
| 7,191,800 | B2 * | 3/2007 | Berner et al. | 137/884 |
| 7,296,839 | B2 * | 11/2007 | Scheerhorn | 296/37.8 |
| 7,591,280 | B2 * | 9/2009 | Narita et al. | 137/269 |

(Continued)

FOREIGN PATENT DOCUMENTS

| | | |
|---|---|---|
| DE | 3615824 | 11/1986 |
| FR | 2655232 | 5/1991 |
| FR | 2665044 | 1/1992 |
| WO | WO2007118487 | 10/2007 |

*Primary Examiner* — John Rivell
*Assistant Examiner* — Minh Le
(74) *Attorney, Agent, or Firm* — Hoffmann & Baron, LLP

(57) ABSTRACT

A modular control device (1) is proposed, containing a support module arrangement (3) equipped with a control module arrangement (15). Additionally provided information-carrying modules (42) make it possible to make information regarding the control modules (16) available. They respectively contain a fastening section (43) fixed in place on the support module arrangement (3) and an information-carrying section (45), which is pivotably seated on hinge means (44). The information-carrying section is embodied in an L-shape and can be selectively positioned in a working position, in which it extends over the control module arrangement (15), or in a release position, in which it makes the control module arrangement (15) accessible.

17 Claims, 4 Drawing Sheets

U.S. PATENT DOCUMENTS 7,607,452 B2 * 10/2009 Kuhbauch et al. ..... 137/269
8,061,379 B2 * 11/2011 Inaba et al. ..... 137/271
8,066,028 B2 * 11/2011 Kees ..... 137/315.09
8,082,943 B2 * 12/2011 Brenner et al. ..... 137/271
2002/0113459 A1 * 8/2002 Laborie et al. ..... 296/146.6
2005/0052507 A1 * 3/2005 Dewey et al. ..... 347/85
2005/0258314 A1 * 11/2005 Schilles et al. ..... 248/74.1
2007/0044842 A1 * 3/2007 Boertje et al. ..... 137/382

* cited by examiner

MODULAR CONTROL DEVICE, ESPECIALLY OF AN ELECTRO-FLUIDIC TYPE

The invention relates to a modular control device, in particular of the electro-fluidic type, with a support module arrangement having at least one support module, and with a control module arrangement, which is releasably fixed on a support surface of the support module arrangement and has at least one control module, and furthermore with a modular information-carrying arrangement, which has at least one information-carrying module and is fastened to the support module arrangement and extends, at least partially, past the front and the top which faces away from the support surface of the control module arrangement.

In connection with a control device known from WO 2007/118487 A1, a control module arrangement consisting of several control modules, which are lined up with each other, is seated on a support module arrangement put together from several support modules lined up with each other. The control modules, here designed as valve modules, are supplied with pressure medium through the support module arrangement. A modularly designed information-carrying arrangement is fastened on the support module arrangement, which flanks the control module arrangement, inter alia on the front and on the top opposite the support module arrangement, and contains information specifically matched to the control modules, for example information regarding the module type and/or its mode of functioning. The information-carrying arrangement contains several U-shaped support elements extending over the support module arrangement, on which pivotable information carriers are arranged, which extend over the control modules, in which they are releasably fixed in place on respectively two adjoining support elements. If a control module is to be exchanged, the information carriers can be pivoted away without it being necessary to remove them entirely. Assignment problems are prevented by this. On the other hand, the exchange of the control modules can be hindered by the support elements. Furthermore, the type of fastening of the latter is impractical in many cases, because they must be fastened on the front, as well as on the back of the support module arrangement.

It is the object of the present invention to create a modular control device of the type mentioned at the outset, which has a simply constructed, and yet easily manipulable information system for the existing control module(s).

To attain this object, the information-carrying arrangement contains at least one information-carrying module, which has a fastening section fastened on the support module arrangement in the area of the front of the control module arrangement, and an L-shaped information-carrying section, pivotably arranged on the fastening section in the area of the free end of its first L-shaped leg by hinge means, in such a way that the information-carrying section can be selectively positioned into a work position, in which it is pivoted against the control module arrangement, or into a release position, in which it is pivoted away from the control module arrangement, and in which in the working position it extends upward with its first L-shaped leg past the front of the control module arrangement, and with the second L-shaped leg connected therewith it extends at least for some distance past the top of the control module in the direction toward its back, and wherein in the release position it is pivoted toward the front away from the top and the front of the control module arrangement.

With its two legs, the information-carrying arrangement, designed in an L-shape, offers the possibility of applying or storing information relevant for the operation of the control device, in particular of information regarding the type and purpose of employment of the installed control modules. If required, both L-shaped legs can be employed for presenting the required information, which assures the availability of the information in a clear-to-recognize form. If a control module is to be exchanged, or is to be removed from the carrier module arrangement for other purposes, it is possible to pivot the information-carrying section forward into a release position, which makes both the top, as well as the front of the control module arrangement accessible. As a result, a control module which is to be exchanged can be very comfortably grasped from above by its exposed front and by its back, which is not covered from the start. Because the information-carrying section does not also extend over the rear of the control module arrangement, pivoting between the release position and the operating position is made easy, and the possibility exists of limiting the length of the second L-shaped leg in such a way that in the rear it does not extend past the control module arrangement. This makes compact cross-sectional dimensions of the control device possible.

Advantageous further developments of the invention ensue from the dependent claims.

The measures in accordance with the invention prove themselves particularly advantageous in connection with an electro-fluidic control device, of which one, several or all valve modules as designed as electrically operable valve modules. As a rule, a special range of tasks is assigned to each valve module in this case, as a rule a consumer which is to be triggered, for which the information-carrying module assigned to the respective valve module can be used for individually identifying the valve modules, for example in respect to the assigned consumer.

The control module arrangement is preferably composed of a plurality of individual control modules, which are releasably fastened in an independent manner on the support surface of the carrier module arrangement and rest next to each other in a line-up direction. Here, the fronts of the control modules are oriented at right angles in regard to the line-up direction. Here the option exists in principle to embody one or several information-carrying modules in their width in such a way that in the operating position they extend simultaneously over several control modules, which are arranged directly next to each other. However, a structural form is considered to be particularly advantageous in which at least one, and preferably all existing control modules have their own individually assigned information-carrying module, and that in the operating position this extends exclusively over this respective control module. Here, the exchange of a control module requires the handling of only one information-carrying module.

A support module arrangement equipped with several control modules can in principle consist of only one support module, whose length is sufficient for receiving the existing plurality of control modules. However, a modular structure is also suitable here to the effect that several individual support modules are lined up and connected with each other, wherein the dimensions of each support module have been selected in such a way that it can receive either only one control module, or several control modules simultaneously.

If an information-carrying module is individually assigned to a control module, its information-carrying section suitably has the same width as the assigned control module. In this way, in the operating position, information-carrying sections which are located directly next to each other can also take on a protective covering function in regard to the control module arrangement.

To the extent that the information-carrying arrangement contains several information-carrying modules, their information-carrying sections can be suitably pivoted, independently of each other, in relation to the carrier module arrangement around the pivot axis defined by the hinge means.

The L-shaped information-carrying section is suitably composed of L-shaped legs, which are designed substantially flat and plate-shaped, so that for one it offers an ample width for complementing it with the required information and, on the other hand, only has a minimum thickness, so that it increases the dimensions of the control device only negligibly.

Suitably at least one complement section, to which a, for example shield-shaped information-carrying element, can be attached in a releasable manner, is located on the information-carrying support section. The information-carrying element can be clipped on in an exchangeable manner, for example by means of a clip-on connection. Furthermore, there is the possibility of forming at least one pocket in the interior of the information-carrying section, into which an information-carrying element can be inserted, whose information can then easily be read out from the outside through a transparent wall section of the information-carrying section.

A protection device against damage of the control module can be simultaneously connected with the installation of the information-carrying attachment if the second L-shaped leg is embodied to be of such a length that it extends at least approximately as far as the rear of the control module arrangement. In this way the entire top of the control modules can be covered.

This covering function is also usable in particular if it is intended to prevent the accidental damage of installations present on a control module. Thus, control modules embodied as valve modules often have an optional manually operable auxiliary actuating device in the area of their back, whose actuating means can be shielded by the second L-shaped leg in such a way that they are not accessible for activation when the information-carrying section has been pivoted into its operating position.

It is furthermore advantageous for the at least one information-carrying module to be equipped with snap-in connection means, which make possible the releasable snapping-in of the information-carrying section into its operating position. In this way the information-carrying module remains securely in its operating position, even if the control device is installed in a position in which its top is oriented to the side or downward, for example.

Snapping-in can be provided between the information-carrying section and the at least one assigned control module. If the control module is embodied as a valve module, and if it has a manually actuable auxiliary actuating device, it is possible in particular to accomplish this snapping-in by means of a component of this manually operable auxiliary actuating device. If the second L-shaped leg extends past the manually operable auxiliary actuating device, and if the latter is yet intended to remain accessible for actuation, the second L-shaped leg can have at least one cutout, which makes access for an actuating tool possible.

Additionally or alternatively, snap-in connection means can also be provided in such a way that a snap-in connection takes place between the first L-shaped leg and the fastening section. This assures a fixation in the operating position also in those cases in which a snap-in connection with a control module is not possible, or no control module at all exists at the time in the respective location.

The fastening section is in particular releasably fixed in place on the support module arrangement. This can be realized, for example, by a snap-in connection.

It is advantageous if the information-carrying module is fixed in place on the support module arrangement by means of the interposition of a socket element, which is separate from it and the support module arrangement. With the information-carrying module disassembled, this in particular also offers an opportunity of directly employing the socket element itself as the information carrier, and to fasten an information-carrying element, for example an imprinted label, directly on it. A socket element, in connection with a control module arrangement containing several control modules, can easily have such a dimension that it is possible to simultaneously fix the fastening sections of several information-carrying modules together on it.

The hinge means are suitably embodied in the form of a so-called film hinge, in which case they contain at least one easily bendable strip of a flexible material connecting the first L-shaped leg with the fastening section, so that it is connected in one piece with the two components. Such an information-carrying module can be produced in a cost-efficient manner by injection molding.

It is of advantage regarding the position of the hinge means if they lie at least substantially on the same level as the supporting surface of the support module arrangement, so that the pivotable first L-shaped leg extends over the entire height of the control module arrangement. It is furthermore of advantage if the hinge means are placed ahead and at a distance from the front of the control module arrangement, so that the free end of the first L-shaped leg connected with the hinge means also comes to lie at a defined distance from the front of the control module arrangement when the information-carrying section is pivoted into the release position.

In what follows, the invention will be explained in greater detail by means of the attached drawings. Shown therein are in:

FIG. 1, a preferred embodiment of a modular control device in accordance with the invention in a perspective view, here in a particularly preferred electro-fluidic construction, equipped with several control modules, to each of which its own information-carrying module has been individually assigned and is shown in different positions, FIG. 2, the control device in FIG. 1 in cross section in accordance with section lines II-II in the area of an information-carrying module assuming the operating position, FIG. 3, the section III, framed in dash-dotted lines, in an enlarged representation, FIG. 4, a section through the arrangement of FIG. 3 in accordance with the section line IV-IV, FIG. 5, an individual perspective representation of a component consisting of a support module and a control module, whose information-carrying module is represented with the information-carrying section pivoted into the release position, FIG. 6, an individual representation of the information-carrying module in a lateral view, with the information-carrying section pivoted into the release position, in which a cover, which is pivoted into the open position and which covers a receiving pocket for the insertion of an information-carrying element, is also visible, FIG. 7, a section through the arrangement in FIG. 5 along a section line VII-VII, and FIG. 8, the section VIII, framed in dash-dotted lines in FIG. 7, in an enlarged representation.

By way of example, the modular control device, identified as a whole by the reference numeral 1, is of an electro-fluidic construction and makes possible a fluidic control of consumers, not further represented, on the basis of electrical control signals. The work fluid employed for the fluidic control is compressed air in particular, but can also be a hydraulic medium.

The control device 1 contains a modularly-constructed base unit 2, which includes a support module arrangement 3 and has been put together from several individual support modules 4. The support modules 4 have been attached directly side-by-side in an alignment direction identified by a two-headed arrow, and in the present case the alignment direction 5 extends in the same direction as the longitudinal axis 6 of the control device 1.

As can be taken from FIG. 5, the individual support modules 4 suitably have a plate shape and are oriented in such a way that the levels of their plates extend at right angles to the alignment direction 5.

Together, all support modules 4 define an upward pointing support surface 7 which, as a result, is divided into individual support surface sections formed on the support modules 4.

In the alignment direction 5, several support module conduits 8 pass through the support module arrangement 3, all of which terminate at each support section of the support surface 7. A central introduction and removal of the work fluid is provided through them.

Furthermore, several consumer conduits 12 extend transversely to the alignment direction 5 in each support module 4 and terminate toward a laterally oriented exterior surface—in this case on the front of the control device 1—, where they make a transition into connector units 13, to which fluid lines leading to the consumers can be releasably connected.

By way of example, the filling and emptying of the support module conduits 8 takes place via a filling and emptying module 14 of the base unit 2, which has been installed on the support module arrangement 3.

A control module arrangement 15 is releasably fastened on the support surface 7. It contains several individual control modules 16 arranged side-by-side in the alignment direction 5, which are fixed in place on the support module arrangement 3 independently of each other. Fastening screws used for this are indicated at 17.

In the exemplary embodiment, each support module 4 is equipped with its own control module 16. The width of the support modules 4 and of the control modules 16, measured in the alignment direction 5, is substantially the same for each. It would also be conceivable to embody one and the same support module 4 to have such a width that at least two control modules 16 can be fastened thereon. This applies in particular in the case in which the support module arrangement 3 has only a single support module 4 which, for example, has a plate-shaped dimension.

Each of the control modules 16 has an oblong shape and is aligned at right angles in respect to the alignment direction 5, so that their flanks extend along their long sides and their longitudinal axes 18 are oriented at right angles in respect to the alignment direction 5 and at the same time parallel to the support surface 7. In what follows, the one front face of the control modules 16 pointing in the axial direction of the longitudinal axis will be called the front 22, the opposite front face will be called the back 23. Furthermore, the long side of the control modules 16 facing away from the support surface 7 will be called the top 24.

The control modules 16 of the exemplary embodiment are electrically actuable valve modules. In particular, they are pilot-controlled multi-path valves. They contain a main valve 25 located in the front area with an internal valve slide 26, and an electrically actuable pilot-controlled valve arrangement 27, attached to the rear of the main valve 25 with one or two electrically actuable pilot valves, generally embodied as solenoid valves.

All control modules 16 are connected to the electrical signal transmission means 32 by means of plug-in connecting means 28, which extend through the base unit 2 and also pass through the support module arrangement 3, and lead to an interface module 33, which is also embodied as a component of the base unit 2, and from where an electrical connection to an external electronic control device, not further represented, is possible.

Each one of the control modules 16 embodied as valve modules has internal valve conduits 34, only sketched in, which terminate at the underside and which, in the state mounted on the support surface 7, are in connection with the support module conduits 8 and consumer conduits 12 terminating there.

A fluidic activation of the main valves 25 takes place by means of electrical control signals, which are supplied to the pilot-controlled valve arrangements 27 via the electrical signal transmission means 32, in order to position the respective valve slide 26 in such a way that the consumer conduits 12 are connected with the support module conduits 8 in accordance with a defined pattern. The triggering of the connected consumers is based on this.

The control modules 16, which are embodied in the form of valve modules, are preferably additionally equipped with a manually operable auxiliary actuating arrangement 35, which is in particular a component of the respective pilot-controlled valve arrangement 27. If required, it makes possible manual activation independently of the control signals which can be supplied via the signal transmission means 32.

In the exemplary embodiment, each manually operable auxiliary actuating arrangement 35 contains two actuating elements 36, arranged in the area of the pilot-controlled valve arrangement 27 at the top, which can be actuated by touch for switching the valve unit. Each is enclosed by an upwardly extending ring-shaped housing protrusion 37.

It would be possible to embody one or several of the control modules 16 as purely electrical or electronic control modules, which do not perform any fluid control function, for example as relay modules. If all control modules 16 are of a purely electrical or electronic type, it is possible to do without the described fluid conduits and fluidic interfaces within the control device 1.

For always maintaining an overview of the control functions of the control modules 16, a modular information-carrying arrangement, which as a whole is identified by the reference numeral 38, is assigned to the control module arrangement 15. The former can be provided in a variable manner with information relating to the existing control modules 16, thus, for example, with information regarding the respectively triggered consumer or the type of a respective control module 16.

Suitably, the information-carrying arrangement 38 has several individual information-carrying modules 42, whose number corresponds to that of the existing control modules 16, and wherein such an information-carrying module 42 is individually assigned to each control module 16.

In particular, the information-carrying modules 42 are embodied to be identical with each other and respectively contain a fastening section 43 and an information-carrying section 45, seated thereon in a pivotably movable manner by hinge means 44. The information-carrying section 45 is suitably connected in one piece with the fastening section 43 by the hinge means 44, wherein the hinge means are designed in the manner of a film hinge and are comprised of at least one elastically bendable, flexible, thin strip of material, which is responsible for the desired pivotable movability. The hinge means 44 define a pivot axis 46 extending parallel with the alignment direction 5.

By means of its fastening section 43, each information-carrying module 42 is fastened on the support module arrangement 3 in the area of the front 22 of the control modules 16. In particular, each information-carrying module 42 is fastened on the front of that support module 4, which is equipped with that control module 16 in regard to which the information-carrying module 42 carries the specific information. Thus, this suitably relates to individual component groups, which are respectively composed of a support module 4, a control module 16 fixed in place thereon, and an information-carrying module 42 also fastened on the support module 4. This can be clearly seen in FIG. 5.

The fastening section 43 can in principle be fastened directly on the associated support module 4. Differing from this, the exemplary embodiment merely provides an indirect attachment, in that each fastening section 43 is fastened on an independent base element 47, which in turn has been attached to the front 48, oriented at right angles in respect to the alignment direction 5, of the respective support module 4.

It can be clearly seen from FIG. 4 that the mutual fastening of the fastening section 43 and the base element 47 is suitably provided by first snap-in connecting means 52. By way of example, the base element 47 has a vertical opening with inward-pointing protrusions, into which the fastening section 43 is snapped from above, for which purpose it has suitable snap-in hooks.

For making an exchange of the information-carrying modules 42 possible, the first snap-in connecting means 52 are suitably of the releasable type.

The information-carrying section 45 is designed to be L-shaped. It has two L-shaped legs, arranged at right angles in respect to each other, of which the first L-shaped leg 53 is arranged on the hinge means 44 in the area of its free end, so that the entire L-shaped structure, rigid per se, can be pivoted around the pivot axis 46 in accordance with the arrow 55.

The hinge means 44 are at least substantially located on the same level as the support surface 7, thus in other words substantially at the same height of the support surface 7 in relation to the vertical axis 56 extending at right angles in respect to the alignment direction 5 and the longitudinal axis 18. Starting from this, the first L-shaped leg 53 has a length approximately corresponding to the height of the associated control modules 16. The length of the second L-shaped leg 54 suitably corresponds at least substantially to the length of the control module 16 measured in the axial direction of the longitudinal axis 18. By pivoting in accordance with the arrows 55, the information-carrying sections 45 can be pivoted independently of each other respectively between a working position, visible in FIG. 2, and a release position, visible in FIGS. 5 and 7. In FIG. 1, the two information-carrying sections 45 assigned to the control modules 16 located in the foreground, take up the working position, while the information-carrying section 45 of the control module 16 located the farthest back in the background takes up the release position. Between them, an information-carrying section 45 is shown, taking up an intermediate position in the course of pivoting between the working position and the release position.

In the working position, the information-carrying section 45 is pivoted against the front and top of the associated control module 16. Here, starting from the hinge means 44, its first L-shaped leg 53 protrudes upward directly from the front 22 of the control module 16, while the adjoining second L-shaped leg 54 extends past the control module 16, starting from the front 22 in the direction toward the back 23. Thus, the control module 16 is flanked at its front by the first L-shaped leg 53, and at its top by the second L-shaped leg 54.

When assuming the working position, information carried by an information-carrying section 45 can be unequivocally assigned to the control module 16 located underneath it.

If needed, the entire information-carrying section 45 can be utilized for presenting information. In the exemplary embodiment it is equipped at the first L-shaped leg 53, as well as at the second L-shaped leg 54, with respectively at least one equipment-bearing area 57, in which it is releasably equipped with an information-carrying element 58, particularly of a shield shape. In particular, a releasable snap-in fastening of the information-carrying elements 58 is provided.

Inter alia, in this connection it is of advantage if the two L-shaped legs 53, 54 each have a plate-shaped wall section 62, which extends parallel with the pivot axis 46 and on which at least one equipment-bearing area 57 is provided. Both L-shaped legs 53, 54 can have a U-shaped cross section with the U-opening pointing toward the control module 16, where the plate-shaped wall section 62 constitutes the crossbar of the U.

In particular, the U-shaped legs are designed to be very short, so that the information-carrying section 45 has a flat cross section and rises only slightly, and the exterior dimensions of the control device 1 are not excessively increased.

Because of the elongated shape of the control module 16, the first L-shaped leg 53 is shorter than the second L-shaped leg 54. However, the second L-shaped leg 54 can also be shorter than in the exemplary embodiment, so that it only extends over a partial length of the control module 16.

In an advantageous manner the first L-shaped leg 53 can also be used for covering the actuating elements 36 of the manually operable auxiliary actuating arrangement 35. Having an appropriate length, it extends, as can be seen in FIG. 2, past the actuating elements 36 and covers them at the top in a way so that they are not accessible for actuation.

Second snap-in connecting means 63 can be arranged on the underside of the second L-shaped leg 54 which, in the operating position, provide a releasable connection with the control module 16. By way of example, these second snap-in connecting means 63 have been placed in such a way that they can come into a snapped-in connection with the housing protrusions 37 of the manually operable auxiliary actuating arrangement 35, such as illustrated in FIG. 2. The information-carrying section 45 is dependably fixed in place in the working position by means of this snapped-in state.

If an operation of the actuation elements 36 should be desirable also in the snapped-in working position, each of the second L-shaped legs 54 can be provided with a respective cutout 64, indicated by dash-dotted lines, opposite the actuating elements 36, which permits the passage of an actuating tool.

Suitably the information-carrying section 45 is of at least approximately the same width as the associated control module 16. In this way it also takes on a protective function in that it shields the control module from exterior mechanical influences.

In the release position, the information-carrying section 45 takes up a position which is pivoted away toward the front from the top 24 and from the front 22 of the associated control module 16. In this way the previously still covered control module 16 is not only open on its back 23, but also on its top 24 and its front 22. After releasing the fastening screws 27, it can therefore be comfortably grasped by hand from above and from the front and rear and removed from the support module arrangement 3.

Because the information-carrying section 45 is embodied to be L-shaped, the rear of the control module 16 is not covered by the information-carrying section 45 when it takes up its working position. Thus, the pivot movement can take place completely collision-free, even if the second L-shaped leg 54 ends above the control module prior to reaching the back 23.

A receiving pocket 65, which is releasably closed by a cover 66 and is suitable for receiving an information-carrying element, can be formed in the interior of the information-carrying section 45, for example in the first L-shaped leg 54. FIG. 6 shows the receiving pocket 65 in the open state with the cover 66 pivoted away. The information placed in the receiving pocket 65 can also easily be seen from the outside through a viewing window. For example, the viewing window can be created by a transparent design of the wall of the information-carrying section 45.

Viewed in the working position, the hinge means suitably are located in the area of the exterior of the information-carrying module 42 facing away from the control module 16, so that they are placed ahead at a distance from the control module 16. This leads to the advantageous effect which can be seen in FIG. 8 that the free end 67 following the hinge means 44 already assumes a relatively large distance "a" in respect to the front 22 of the control module 22 when the information-carrying section 45 has been merely pivoted by 90° into a release position, in which its second L-shaped leg 54 projects upward. Thus, an advantageous gripping access to the front 22 is already obtained at a small pivot angle of approximately 90°, which is of advantage since the external conditions often do not permit further pivoting and additional pivoting could moreover be a strain on the service life of the hinge means 44.

For securing the position of the information-carrying section 45 in the working position, third snap-in connecting means 68 are additionally provided in the exemplary embodiment, which are also effective if, based on special circumstances, no control module 16 which can be used for fixation in place, is seated underneath the information-carrying section 45 in its operating position. The third snap-in connecting means 68 are in part located at the free end 67 of the first L-shaped leg, and in part on the adjoining fastening section 43. In the exemplary embodiment, they consist of at least one plastically deformable hook element 68*a* and a holding protrusion 68*b* arranged on the fastening section 43, wherein the hook element 68*a* extends behind the latter while being temporarily deflected in a spring-elastic manner when the information-carrying section 45 pivots into the working position.

In particular, the hook element 68*a* is located on the inside, facing the control module 16, of the first L-shaped leg 53 and projects past it on the bottom, so that it snaps into the fastening section 43 from above when the working position has been reached.

For releasing the snap-in connection it is for example possible to reach into the fastening section 43 from below in order to exert an unlocking force on the hook element 68*a*. It is also possible to provide other access possibilities. Incidentally, this also applies to the remaining snap-in connecting means 52.

The second and third snap-in connecting means 63, 68 in particular can also be particularly designed in such a way that no direct action on them is required for unsnapping, but in that it is sufficient if a sufficiently large actuating force is applied to the information-carrying section 45 for pivoting it into the release position.

Incidentally, if no information-carrying module 42 is desired, the base element 47 can also be alternatively equipped with a differently designed information-carrying element 58. For example, the latter can be simply an inscribed small plate, which can be fixed in place on the first snap-in connecting means 52 of the base element 47.

While in the exemplary embodiment each information-carrying module 42 has been assigned its own base element 47, the possibility basically also exists of making use of at least one base element 47 whose length corresponds to several times the width of a control module 16, so that it is possible to simultaneously fix several information-carrying sections 45 on it side-by-side in the alignment direction 5.

Suitably, the base elements 47 are fastened by being snapped into the support module arrangement 3.

While in the exemplary embodiment the width of the individual information-carrying sections 45 is matched to the width of the respectively assigned control modules 16, the possibility exists in principle to provide at least one information-carrying section 45 with a larger width so that, in the working position, it simultaneously extends over several side-by-side arranged control modules 16. In that case it can also be equipped with information which can be unequivocally assigned to the control module 16 which is respectively located underneath. However, the structural shape of the exemplary embodiment assures the best possible variation option and permits any arbitrary increase of support modules 4 and control modules 16 on the control device 1, in which case it is possible to respectively employ the same type of information-carrying modules 42.

The invention claimed is:

1. A modular control device of the electro-fluidic type, with a support module arrangement having at least one support module, and with a control module arrangement, which is releasably fixed on a support surface of the support module arrangement and has at least one control module, and furthermore with a modular information-carrying arrangement, which has at least one information-carrying module and is fastened to the support module arrangement and extends, at least partially, past a front of the control module arrangement and a top of the control module arrangement which faces away from the support surface of the control module arrangement, wherein the at least one information-carrying module has a fastening section fastened on the support module arrangement in the area of the front of the control module arrangement, and an L-shaped information-carrying section, pivotably arranged on the fastening section in the area of the free end of its first L-shaped leg by hinge means, in such a way that the information-carrying section can be selectively positioned into a work position, in which it is pivoted against the control module arrangement, or into a release position, in which it is pivoted away from the control module arrangement, and in which in the working position it extends upward with its first L-shaped leg past the front of the control module arrangement, and with the second L-shaped leg connected therewith it extends at least for some distance past the top of the control module arrangement in the direction toward the back thereof, and wherein in the release position it is pivoted to the fore away from the top and the front of the control module arrangement, and wherein at least one control module has its own information-carrying module individually assigned to it which, in the working position, extends exclusively over this control module.

2. The modular control device in accordance with claim 1, wherein the modular control device is embodied as an electro-fluidic control device, in which at least one control module is embodied as an electrically actuable valve module, which communicates with fluid conduits extending through the support module arrangement.

3. The modular control device in accordance with claim 1, wherein electrical signal transmission means are arranged in the support module arrangement and are electrically connected with the at least one control module.

4. The modular control device in accordance with claim 1, wherein the control module arrangement has a plurality of control modules, which are releasably fixed side-by-side in an alignment direction on the support surface, wherein the front of the control module arrangement is oriented at right angles in respect to the alignment direction.

5. The modular control device in accordance with claim 4, wherein the support module arrangement has a plurality of support modules, which are placed directly next to each other in the alignment direction and are respectively embodied for being equipped with at least one control module.

6. The modular control device in accordance with claim 1, wherein the information-carrying section is at least approximately of the same width as the associated control module.

7. The modular control device in accordance with claim 1, wherein the L-shaped legs of the information-carrying section respectively have a plate-shaped wall section, which extends parallel to the pivot axis defined by the hinge means, wherein both L-shaped legs have a U-shaped cross section with the U-opening facing the control module.

8. The modular control device in accordance with claim 1, wherein at least one equipment-bearing area is formed on the information-carrying section for releasably equipping it with an information-carrying element which is shield-shaped.

9. The modular control device in accordance with claim 1, wherein the second L-shaped leg is of such a length that in the working position it extends at least approximately as far as the rear of the control module arrangement, while it does not project past the rear of the control module arrangement.

10. The modular control device in accordance with claim 1, wherein snap-in connecting means are provided on the at least one information-carrying module for the releasable connection of the information-carrying section when it takes up the working position.

11. The modular control device in accordance with claim 10, wherein the snap-in connecting means are arranged on the second L-shaped leg and are embodied for being snapped together with a component of a manually operable auxiliary actuating arrangement embodied as a component of the control module.

12. The modular control device in accordance with claim 1, wherein at least one control module is equipped with a manually operable auxiliary actuating arrangement, which makes possible an optional manual actuation and over which the second L-shaped leg of the information-carrying section, which takes up the working position, extends, wherein, as a function of its design, the information-carrying section either covers the actuating means of the manually operable auxiliary actuating arrangement so that they are inaccessible, or keeps them accessible by means of at least one cutout extending through it.

13. The modular control device in accordance with claim 1, wherein the fastening section is fixed in place on the support module arrangement by means of the interposition of a separate base element, wherein the fastening section and the base element are suitably fixed on each other by snap-in connecting means.

14. The modular control device in accordance with claim 1, wherein, by means of at least one strip of flexible material constituting the hinge means, the first L-shaped leg and the fastening section are connected with each other to form one piece.

15. The modular control device in accordance with claim 1, wherein the hinge means are arranged at least substantially on the same level with the support surface, and/or spaced apart from the front of the control module arrangement.

16. A modular control device of the electro-fluidic type, with a support module arrangement having at least one support module, and with a control module arrangement, which is releasably fixed on a support surface of the support module arrangement and has at least one control module, and furthermore with a modular information-carrying arrangement, which has at least one information-carrying module and is fastened to the support module arrangement and extends, at least partially, past a front of the control module arrangement and a top of the control module arrangement which faces away from the support surface of the control module arrangement, wherein the at least one information-carrying module has a fastening section fastened on the support module arrangement in the area of the front of the control module arrangement, and an L-shaped information-carrying section, pivotably arranged on the fastening section in the area of the free end of its first L-shaped leg by hinge means, in such a way that the information-carrying section can be selectively positioned into a work position, in which it is pivoted against the control module arrangement, or into a release position, in which it is pivoted away from the control module arrangement, and in which in the working position it extends upward with its first L-shaped leg past the front of the control module arrangement, and with the second L-shaped leg connected therewith it extends at least for some distance past the top of the control module arrangement in the direction toward the back thereof, and wherein in the release position it is pivoted to the fore away from the top and the front of the control module arrangement, and wherein the information-carrying arrangement has several information-carrying modules, which are respectively individually assigned to at least one control module, and whose information-carrying sections are pivotable independently of each other between the working position and the release position.

17. A modular control device of the electro-fluidic type, with a support module arrangement having at least one support module, and with a control module arrangement, which is releasably fixed on a support surface of the support module arrangement and has at least one control module, and furthermore with a modular information-carrying arrangement, which has at least one information-carrying module and is fastened to the support module arrangement and extends, at least partially, past a front of the control module arrangement and a top of the control module arrangement which faces away from the support surface of the control module arrangement, wherein the at least one information-carrying module has a fastening section fastened on the support module arrangement in the area of the front of the control module arrangement, and an L-shaped information-carrying section, pivotably arranged on the fastening section in the area of the free end of its first L-shaped leg by hinge means, in such a way that the information-carrying section can be selectively positioned into a work position, in which it is pivoted against the control module arrangement, or into a release position, in which it is pivoted away from the control module arrangement, and in which in the working position it extends upward with its first L-shaped leg past the front of the control module arrangement, and with the second L-shaped leg connected therewith it extends at least for some distance past the top of the control module arrangement in the direction toward the back thereof, and wherein in the release position it is pivoted to the fore away from the top and the front of the control module arrangement, and wherein snap-in connecting means are provided on the at least one information-carrying module for the releasable connection of the information-carrying section when it takes up the working position, and wherein the snap-in connecting means are arranged in part on the first L-shaped leg and in part on the fastening section and come into a snapped-in connection with each other for the mutual fixation in place of these two components when the information-carrying section is pivoted into the working position.

* * * * *

UNITED STATES PATENT AND TRADEMARK OFFICE

CERTIFICATE OF CORRECTION

PATENT NO. : 8,413,679 B2
APPLICATION NO. : 12/672035
DATED : April 9, 2013
INVENTOR(S) : Wenske et al.

It is certified that error appears in the above-identified patent and that said Letters Patent is hereby corrected as shown below:

IN THE SPECIFICATION

Column 1, after the title and before line 5, please insert the following:

--This application claims priority based on an International Application filed under the Patent Cooperation Treaty, PCT/EP2008,002981, filed April 15, 2008.

BACKGROUND OF THE INVENTION--

Column 1, after line 42, please insert the following:

--SUMMARY OF THE INVENTION--

Column 4, after line 34, please insert the following:

--BRIEF DESCRIPTION OF THE DRAWINGS--

Column 4, after line 65, please insert the following:

--DETAILED DESCRIPTION OF THE PREFERRED EMBODIMENTS--

Figure 1:
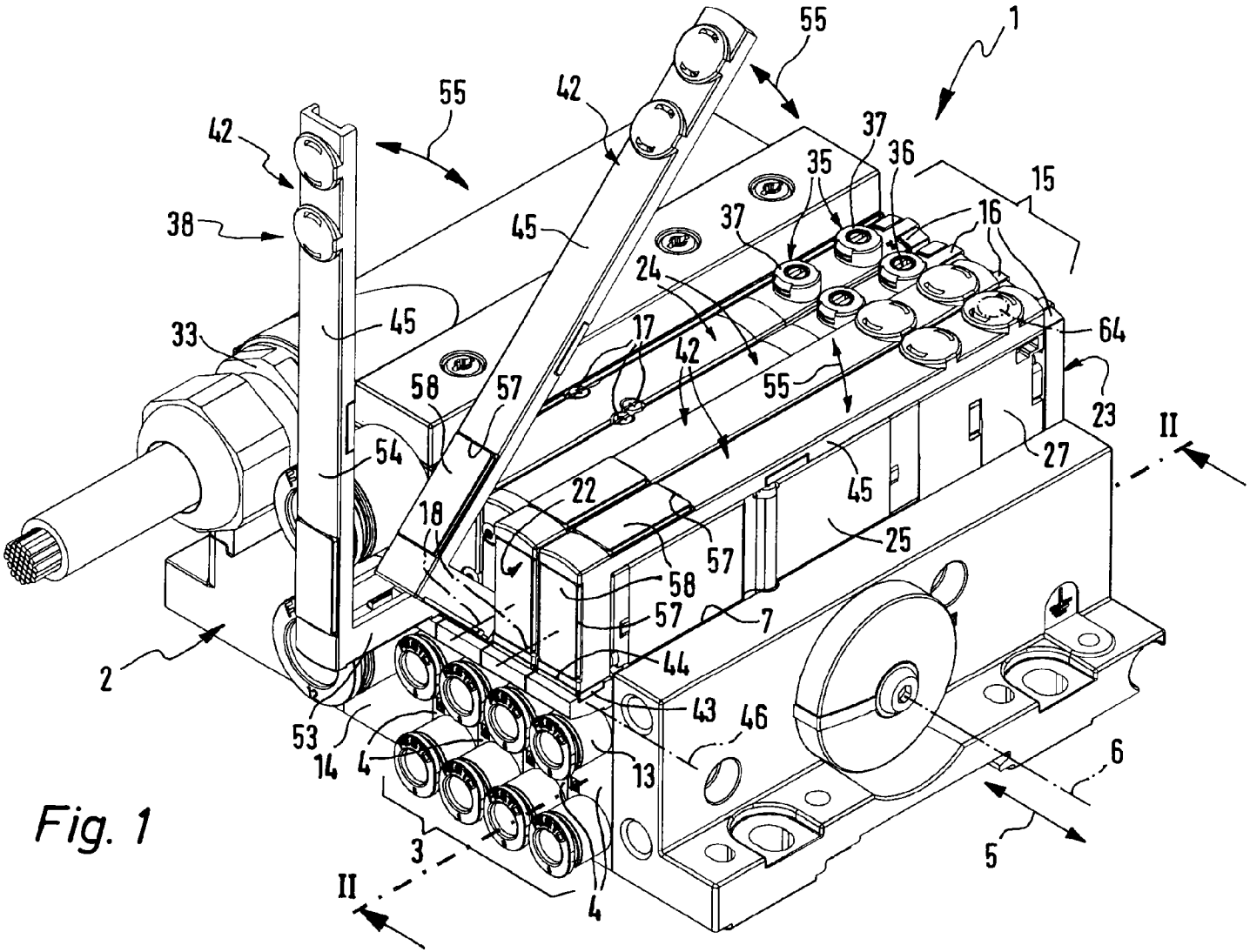
Figure 2:
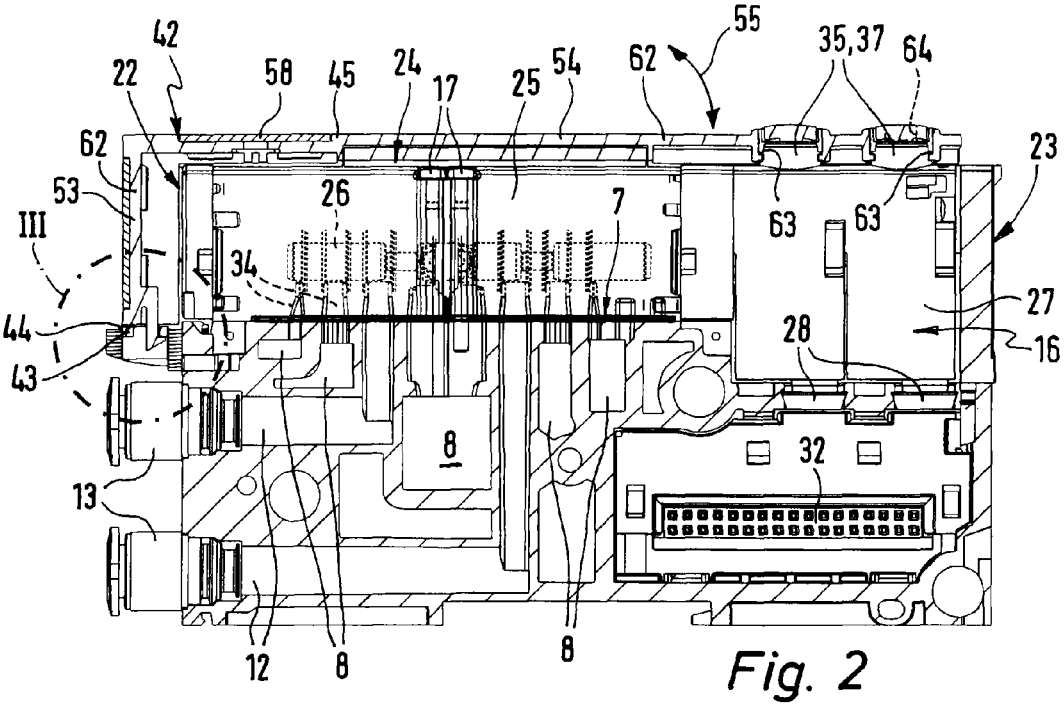
Figure 3:
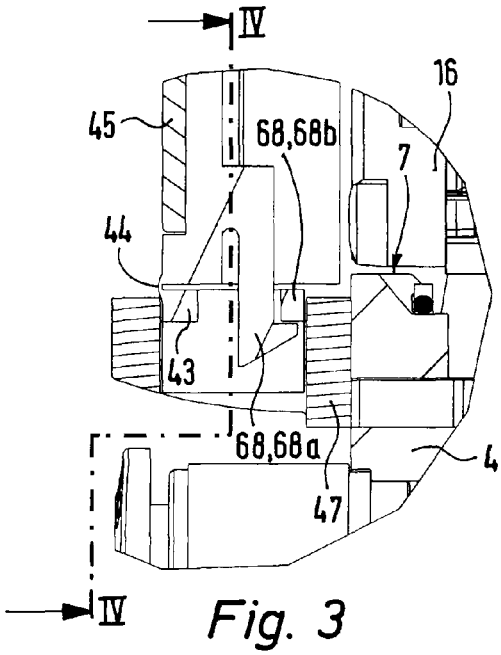
Figure 4:
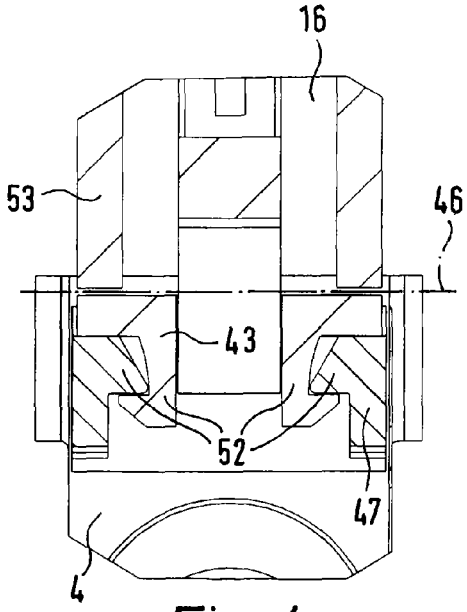
Figure 6:
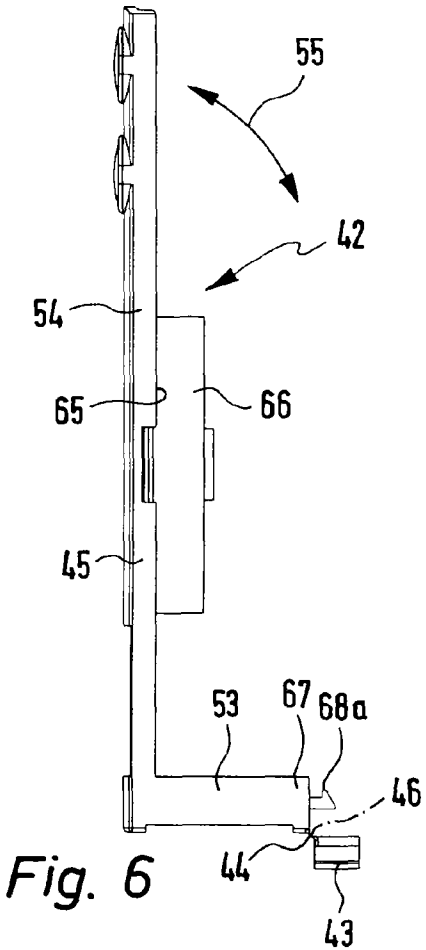
Figure 5:
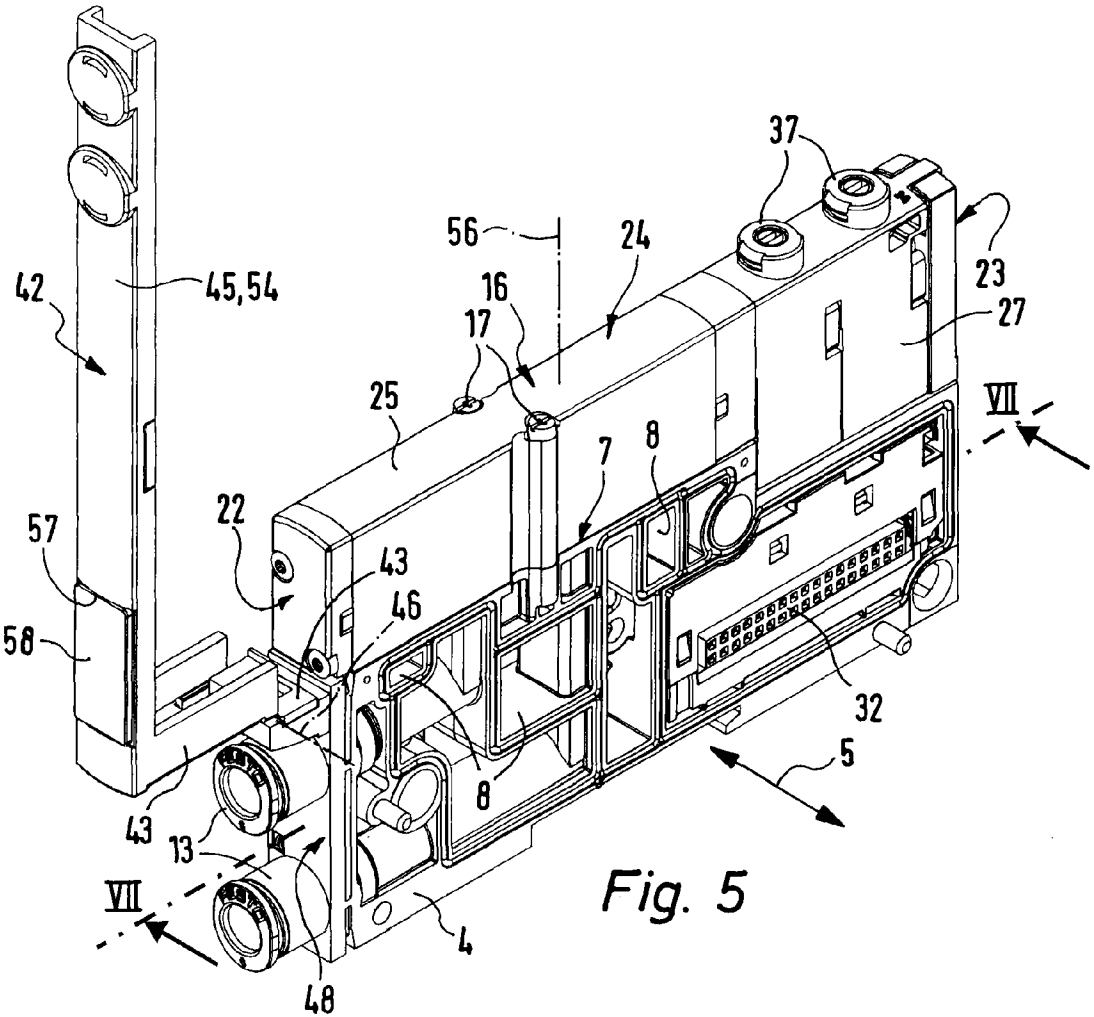
Figure 7:
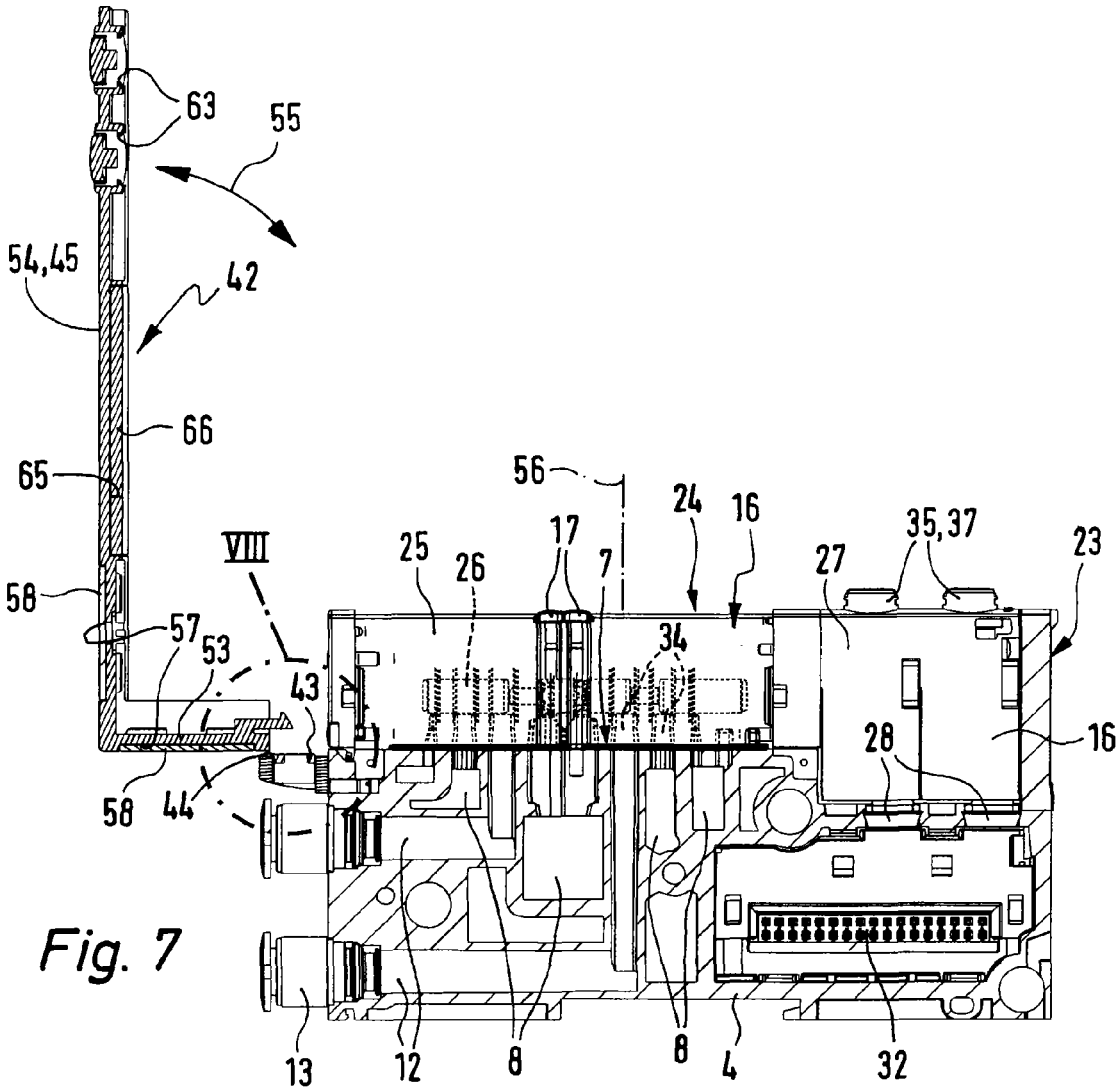
Figure 8:
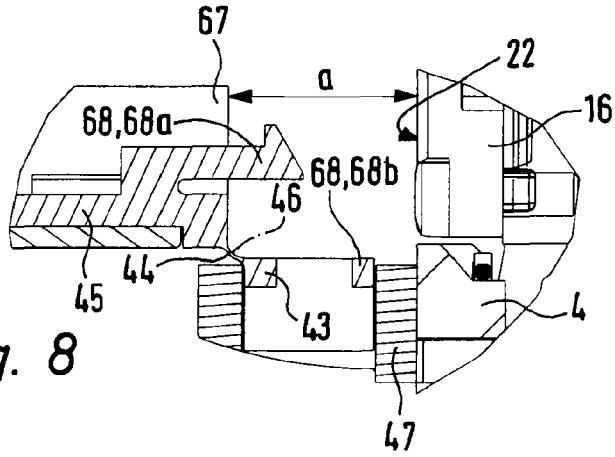

Signed and Sealed this
Twenty-fourth Day of September, 2013

Teresa Stanek Rea
*Deputy Director of the United States Patent and Trademark Office*

UNITED STATES PATENT AND TRADEMARK OFFICE

CERTIFICATE OF CORRECTION

PATENT NO. : 8,413,679 B2
APPLICATION NO. : 12/672035
DATED : April 9, 2013
INVENTOR(S) : Wenske et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 658 days.

Signed and Sealed this
First Day of September, 2015

Michelle K. Lee

Michelle K. Lee
*Director of the United States Patent and Trademark Office*